US006044345A

United States Patent [19]

Veldhuis

[11] Patent Number: 6,044,345

[45] Date of Patent: Mar. 28, 2000

[54] METHOD AND SYSTEM FOR CODING HUMAN SPEECH FOR SUBSEQUENT REPRODUCTION THEREOF

[75] Inventor: Raymond N. J. Veldhuis, Eindhoven, Netherlands

[73] Assignee: U.S. Phillips Corporation, New York, N.Y.

[21] Appl. No.: 09/062,224

[22] Filed: Apr. 17, 1998

[30] Foreign Application Priority Data

Apr. 18, 1997 [EP] European Pat. Off. ..... 97201142

[51] Int. Cl.[7] ..... G10L 9/14

[52] U.S. Cl. ..... 704/261; 704/262

[58] Field of Search ..... 704/261, 260, 704/268, 200, 207, 209, 201, 211, 262, 219

[56] References Cited

U.S. PATENT DOCUMENTS

| | | | |
|---|---|---|---|
| 3,649,765 | 3/1972 | Rabiner et al. | 704/209 |
| 4,433,210 | 2/1984 | Ostrowski et al. | 704/265 |
| 4,618,985 | 10/1986 | Pfeiffer | 395/2.7 |
| 4,754,485 | 6/1988 | Klatt | 395/2.69 |
| 5,479,564 | 12/1995 | Vogten et al. | 395/2.76 |
| 5,577,160 | 11/1996 | Hosom et al. | 395/2.18 |
| 5,602,959 | 2/1997 | Bergstrom et al. | 395/2.14 |
| 5,611,002 | 3/1997 | Vogten et al. | 395/2.76 |
| 5,617,507 | 4/1997 | Lee et al. | 704/200 |
| 5,706,392 | 1/1998 | Goldberg et al. | 704/210 |

OTHER PUBLICATIONS

A. Rosenberg, (1971), Effect of Glottal Pulse Shape on the Quality of Natural Vowels, Journal of the Acoustical Society of America 49, 583–590.

Klatt, D.H. & Klan, L.C. (1990), Analysis Synthesis and Perception of Voice Quality Variations among Female and Male Talkers. Journal of the Accousitcal Society of America, 87, pp. 820–857.

G. Fant, J. Liljencrats & Qi–guang Lin, A Four–Parameter Model of Glottal Flow, French–Swedish Symposium, Grenobole, Apr. 22–24, 1985, STL–QPSR4/1985, pp. 1–13.

U.S. application No. 08/778,795.

U.S. application No. 08/754,362.

*Primary Examiner*—Richemond Dorvil

*Attorney, Agent, or Firm*—Russell Gross

[57] ABSTRACT

Human speech is coded by singling out from a transfer function of the speech, all poles that are unrelated to any particular resonance of a human vocal tract model. All other poles are maintained. A glottal pulse related sequence is defined representing the singled out poles through an explicitation of the derivative of the glottal air flow. Speech is outputted by a filter based on combining the glottal pulse related sequence and a representation of a formant filter with a complex transfer function expressing all other poles. The glottal pulse sequence is modelled through further explicitly expressible generation parameters. In particular, a non-zero decaying return phase supplemented to the glottal-pulse response that is explicitized in all its parameters, while amending the overall response in accordance with volumetric continuity.

4 Claims, 5 Drawing Sheets

$$g(t)=\begin{cases} f(t) & \text{for } 0 \le t < t_e \\ f(t_e)\dfrac{\exp\left(-\dfrac{(t-t_e)}{t_a}\right)-\exp\left(-\dfrac{(t_0-t_e)}{t_a}\right)}{1-\exp\left(-\dfrac{(t_0-t_e)}{t_a}\right)} & \text{for } t_e \le t < t_0 \end{cases} \tag{2}$$

FIG. 6a $$g(t)=\begin{cases} \int_0^t f(\tau)\,d\tau & \text{for } 0 \le t < t_e \\ \int_0^{t_e} f(\tau)\,d\tau + t_a f(t_e)\dfrac{1-\exp\left(-\dfrac{(t-t_e)}{t_a}\right)-\dfrac{t-t_e}{t_a}\exp\left(-\dfrac{(t_0-t_e)}{t_a}\right)}{1-\exp\left(-\dfrac{(t_0-t_e)}{t_a}\right)} & \text{for } t_e \le t < t_0 \end{cases} \tag{3}$$

FIG. 6b $$\int_0^{t_e} f(\tau)\,d\tau + t_a f(t_e)\,D(t_0,t_e,t_a)=0 \tag{4}$$

FIG. 6c $$D(t_0,t_e,t_a)=\frac{1-\dfrac{t_0-t_e+t_a}{t_a}\exp\left(-\dfrac{(t_0-t_e)}{t_a}\right)}{1-\exp\left(-\dfrac{(t_0-t_e)}{t_a}\right)} \tag{5}$$

FIG. 6d $$f(t)=B\sin\left(\pi\frac{t}{t_p}\right)\exp(\alpha t) \tag{6}$$

FIG. 6e $$\frac{\pi-\exp(\alpha t_e)\left(\pi\cos\left(\pi\frac{t_e}{t_p}\right)-\alpha t_p\sin\left(\pi\frac{t_e}{t_p}\right)\right)}{\pi^2+(\alpha\pi)^2}+\frac{t_a}{t_p}\exp(\alpha t_e)\sin\left(\pi\frac{t_e}{t_p}\right)D(t_0,t_e,t_a)=0 \quad (7)$$

FIG. 6f $$g(t)=\begin{cases}At^2(t_e-t) & \text{for } 0\le t<t_e\\ 0 & \text{for } t_e\le t<t_0\end{cases} \qquad g(t)=\begin{cases}3At(\frac{2}{3}t_e-t) & \text{for } 0\le t<t_e\\ 0 & \text{for } t_e\le t<t_0\end{cases} \quad (8)$$

FIG. 6g $$f(t)=4At(t_p-t)(t_x-t) \qquad \int_0^t f(\tau)\,d\tau=At^2\left(t^2-\frac{4}{3}t(t_p+t_x)+2t_pt_x\right) \quad (9)$$

FIG. 6h $$t_x=t_e\,\frac{t_e^2-\frac{4}{3}t_et_p+4t_a(t_e-t_p)D(t_0,t_e,t_a)}{\frac{4}{3}t_e^2-2t_et_p+4t_a(t_e-t_p)D(t_0,t_e,t_a)} \quad (10)$$

FIG. 6i $$t_p=\frac{2}{3}t_e\,\frac{t_e+3t_a\,D(t_0,t_e,t_a)}{t_e+2t_a\,D(t_0,t_e,t_a)} \quad (11)$$

FIG. 6j $$\frac{1}{2}t_e\le t_p\le\frac{3}{4}t_e\,\frac{t_e+4t_a\,D(t_0,t_e,t_a)}{t_e+3t_a\,D(t_0,t_e,t_a)} \quad (13)$$

FIG. 6k

METHOD AND SYSTEM FOR CODING HUMAN SPEECH FOR SUBSEQUENT REPRODUCTION THEREOF

BACKGROUND TO THE INVENTION

The invention relates to a method for coding human speech for subsequent reproduction thereof. Generally, methods based on the principles of LPC-coding will produce speech of only moderate quality. The present inventor has found that the principles of LPC coding represent a good starting point for seeking further improvement. In particular, the values of LPC filter characteristics may be adapted, to get a better result if the various influences thereof on speech generation are taken into account in a more refined manner.

Such method has been disclosed in A. Rosenberg, (1971), Effect of Glottal Pulse Shape on the Quality of Natural Vowels, Journal of the Acoustical Society of America 49, 583–590. From a computational point of view this method is extremely straightforward, in that the expressions for the glottal pulse flow and its time derivative are explicit in the relevant parameters. The results however have been found insufficient, both from a psychoacoustic and also from a speech production point of view, in that various generation parameters could not be chosen in an optimal manner. In particular, this is caused by the absence of a return phase in the glottal pulse response curve.

SUMMARY TO THE INVENTION

Accordingly, amongst other things it is an object of the present invention to retain the advantageous computational properties of the method according to the preamble whilst upgrading its psychoacoustical and speech production results, through adding a return phase. Now, according to one of its aspects, the invention is characterized by supplementing a non-zero decaying return phase to the glottal-pulse response that is explicitized in all its parameters, whilst amending the overall response in accordance with volumetric continuity. The volumetric continuity is expressed by redefining $t_e$, that is the instant when the time-derivative of the glottal response becomes minimum. Processing speed remains invariably high. The so-called Rosenberg++-model is an extension of the original Rosenberg model, that can be written according to equation (8) hereinafter.

Equation (8) however has no return phase and also has $t_p=2t_e/3$, or rk=1/3. This limits its flexibility. A first improvement is thus to add this return phase. By itself, it has been proposed to introduce a pseudo return phase by applying a first order recursive low-pass filter to the glottal pulse derivative, cf. Klatt, D. H. & Klatt, L. C. (1990). Analysis, Synthesis and Perception of Voice Quality Variations among Female and Male Talkers. Journal of the Acoustical Society of America, 87,820856. However, this will undesirably change the value of $t_p$. Further, another prior art has introduced a return phase through expression (2). This involves a great amount of additional processing, so that usage thereof remains restricted to environments where processing power is not a limiting factor.

Advantageously, the glottal pulse response introduces a factor that is explicit in the parameter $t_p$, that is the instant of maximum airflow. This second extension adds an extra factor in f(t), which allows to specify $t_p$; this results in equation (9), whilst leading to a further improvement in perceptual performance. Expression (10) for $t_x$ results from solving the continuity equation (4): the denominator of (1) vanishes when equation (11) applies. In that case, the Rosenberg++ model reduces to $$f(t)=3At(t_p-t);\ f\epsilon f(T)dX=At^2(1.5t_p-t), \tag{12}$$

which represents the Rosenberg model with only a return phase supplemented. Condition (13) is required in order to guarantee that g(t) is non-negative. The Rosenberg++ model has the same set of T (or R) parameters as the LF model (based on equation (2)) to be discussed hereinafter, but requires fewer calculations, since the continuity equation does not need a numerical, but only an analytical solution.

Advantageously, the method is characterized by selectively amending one or more of the speech governing parameters $t_p$, $t_e$, that is the instant where the derivative in the glottal pulse is minimum, and $t_a$, that is the first order delay after $t_e$ where the derivative becomes zero. This amending is now straightforward, and allows to instantaneously vary speech quality if required.

The LF method has been described in U.S. application Ser. No. 08/778,795 (PHN 15,641) to the present assignee, herein incorporated by reference. This art generates speech that is adequate from a perceptive point of view, but its data processing requirements have made application in moderate size, stand-alone systems illusory.

The invention also relates to a system arranged for implementing the method according to the invention.

By itself, manipulating speech in various ways has been disclosed in U.S. Pat. No. 5,479,564 (PHN 13801), U.S. application Ser. No. 07/924,726 (PHN 13993), and U.S. application Ser. No. 08/754,362 (PHN 15553), all to the present assignee. The first two references describe affecting speech duration through systematically inserting and/or deleting pitch periods of the unprocessed speech. The third reference operates in comparable manner on a short-time-Fourier-transform of the speech. The present invention seeks a compact storage and straightforward processing of coded speech to attain a low cost solution. The references require a rather more extensive storage space.

BRIEF DESCRIPTION OF THE DRAWING

These and other aspects and advantages of the invention will be described with reference to the preferred embodiments disclosed hereinafter, and in particular with reference to the appended Figures that show:

FIGS. 6*a* to 6*k* various expressions used in the disclosure.

DESCRIPTION OF PREFERRED EMBODIMENTS

Figure 1:
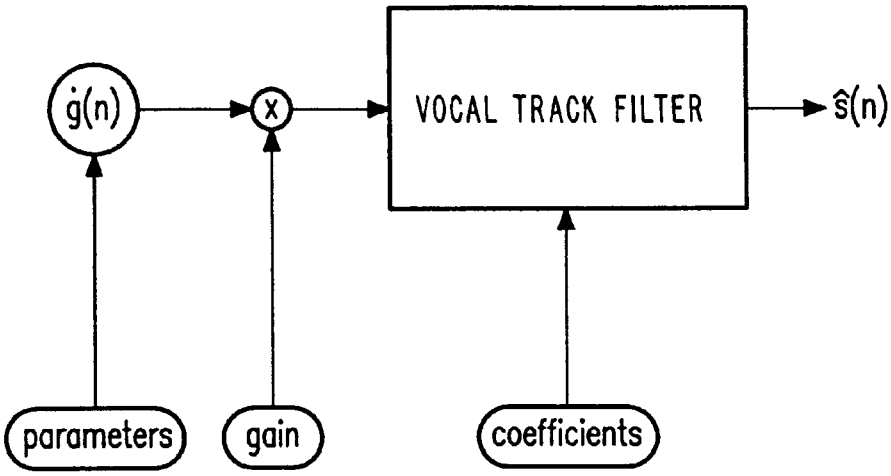
FIG. 1, a block diagram of a speech synthesizer.

The proposed synthesizer is shown in FIG. 1. Because the system should remain compatible with existing data bases, the parameters must be generated pertaining to the sources in FIG. 1. This is done as follows. The filter coefficients of the original synthesis filter are used to derive the coefficients of the vocal-tract filter and of the glottal-pulse filter, respectively. Earlier, the Liljencrants-Fant (LF) model was used for describing the glottal pulse as cited infra. The parameters thereof are tuned to attain magnitude-matching in the frequency domain between the glottal pulse filter and the LF pulse. This leads to an excitation of the vocal tract filter that has both the desired spectral characteristics as well as a realistic temporal representation.

The procedure may be extended as follows. The estimating of the complex poles of the transfer function of the LPC speech synthesis filter which has a spectral envelope corresponding to the human speech information, includes estimating a fixed first line spectrum that is associated to expression (A) hereinafter. Moreover, the procedure includes estimating a fixed second line spectrum that is associated to expression (C) hereinafter, as pertaining to the human vocal tract model. The procedure further includes finding of a variable third line spectrum, associated to expression (C) hereinafter, which corresponds to the glottal pulse related sequence, for matching the third line spectrum to the estimated first line spectrum, until attaining an appropriate matching level.

Figure 2A:
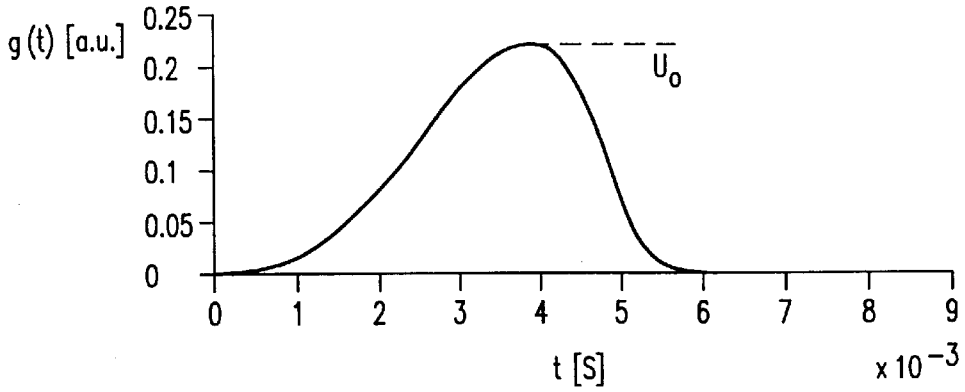
FIGS. 2*a*, 2*b* a glottal pulse and its time derivative.

FIGS. 2*a,* 2*b* give an exemplary glottal pulse and its time derivative, respectively, as modelled. The sampling frequency is $f_s$, the fundamental frequency is $f_0$, the fundamental period is $t_0=1/f_0$. Further, $t_p=2\pi/\omega_p$. The parameters used herein are the so-called specification parameters, that are equivalent with the generation parameters but are more closely related to the physical aspects of the speech generation instrument. In particular, $t_e$ and $t_a$ have no immediate translation to the generation parameters. Note that the signal segment as shown contains at least two fundamental periods.

Figure 2B:
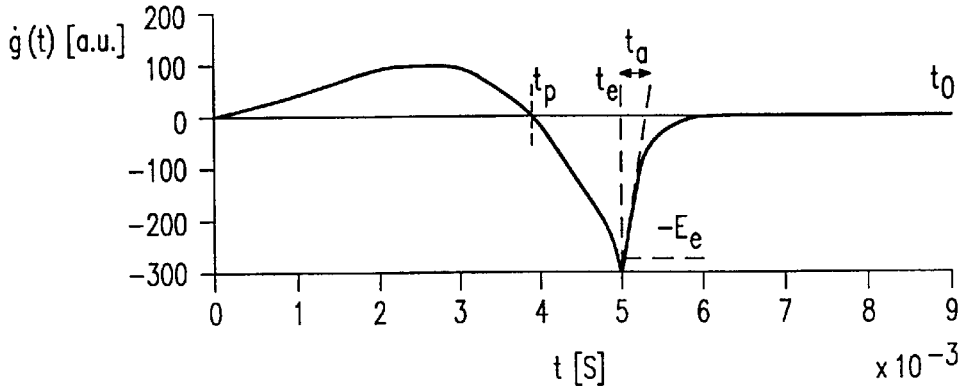

In FIG. 2*b,* the graph part for time values greater than $t_e$ is perceptively the most relevant one. As shown hereinafter, this tail part will be maintained identically by the present invention with respect to the Liljencrantz-Fant method. The complicating aspects of the function chosen for lower time values than $t_e$ will however be mitigated. In particular, α-less generation parameters will be used. This renders them identical to the specification parameters. The whole solution is attained without taking recourse to non-linear equations. Further, it will be shown that parameters can now be changed more easily, for controlling the speech quality in a more straightforward matter.

Now, the signal line spectrum is $$S_l = \left|\sum_{k=0}^{M-1} s_k w_k \exp\left(-jkl2\pi\frac{f_0}{f_s}\right)\right|^2,\ l = 1, \ldots, N, \tag{A}$$

(with $w_k$, k=0, . . . , M−1 a window function, e.g. the Hanning window, and $$N = \left\lfloor \frac{f_s}{2f_0} \right\rfloor \tag{B}$$

is the number of spectral lines in the spectrum. The vocal-tract line spectrum is $$A_l = \left|A\left(\exp\left(jl2\pi\frac{f_0}{f_s}\right)\right)\right|^2,\ l = 1, \ldots, N, \tag{C}$$

with A(exp(jθ)) the transfer function of the vocal-tract filter. The glottal-pulse line spectrum is $$G_l(t_0, t_e, t_p, t_a) = \left|\int_0^{t_0} \dot{g}(t; t_0, t_e, t_p, t_a)\exp(-2j\pi l f_0 t)dt\right|^2,\quad l = 1, \ldots, N, \tag{D}$$

with $g(t;t_0,t_e,t_p,t_a)$ the time derivative of the glottal pulse e.g. according to the LF model. The glottal pulse parameters $t_e$, $t_p$, $t_a$ are obtained as the minimizing arguments of the function $$D_{KL}(t_e, t_p, t_a) = \sum_{l=1}^{N}\left(\frac{S_l^\beta}{\sum_m S_m^\beta}\right)\log\left(\frac{\left(\frac{S_l^\beta}{\sum_m S_m^\alpha}\right)}{\left(\frac{(A_l G_l(t_0, t_e, t_p, t_a))^\beta}{\sum_m (A_m G_m(t_0, t_e, t_p, t_a))^\beta}\right)}\right), \tag{E}$$

with β added to increase the perceptual relevance of this distance measure. It has been found that β=1/3 gives satisfactory results. An alternative distance measure is $$D_{sd}(t_e, t_p, t_a) = \sum_{l=1}^{N}\left(\log\left(\frac{\left(\frac{S_l}{\sum_m S_m}\right)}{\left(\frac{A_l G_l(t_0, t_e, t_p, t_a)}{\sum_m A_m G_m(T_0, t_e, t_p, t_a)}\right)}\right)\right)^2 \tag{F}$$

Minimizing of function values until attaining either the overall minimum, or at least an appropriate level, is a straightforward mathematical procedure and leads to agreeable speech.

The Rosenberg++ model is described by the same set of T or R parameters as the LF model, but is computationally more simple. This allows its use in real-time speech synthesizers. In practical situations, the Rosenberg++ model produces synthetic speech that is perceptually equivalent to speech generated with the LF model.

Figure 3:
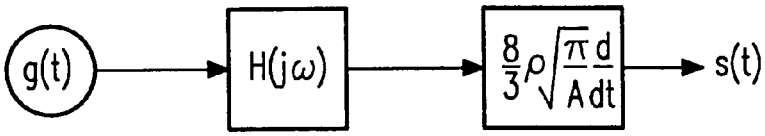
FIG. 3, a source-filter model with glottal source.
Figure 4:
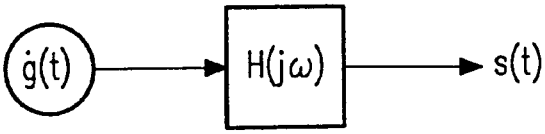
FIG. 4, a simplified source-filter model.

For analysis and synthesis purposes, speech production is often modelled by a source-filter model (FIGS. 3, 4). In FIG. 3, a source produces a signal B(t) that models the air flow passing the vocal cords, a filter with a transfer function H(jω) models the spectral shaping by the vocal tract and a differentiation operator models the conversion of the air flow to a pressure wave s(t) as it takes place at the lips and which is called lip radiation. The constants ρ and A are the density of air, and the area of the lip opening, respectively. FIG. 4 is a simplified version of this model, in which the differentiation operator has been combined with the source, which now produces the time derivative dg(t)/dt of the air flow passing the vocal cords. The opening between the vocal cords is called glottis, and the source is called the glottal source. In voiced speech the signal g(t) is periodic and one period is called a glottal pulse. The glottal pulse and its time derivative determine the voice quality and to are related to the production of prosody. The time-derivative is studied, rather than the glottal pulse itself, because the former is easier obtained from the speech signal for deriving some of the glottal-source parameters.

The Liljencrants-Fant (LF) model has become a reference model for glottal-pulse analysis, cf. G. Fant, J. Liljencrants & Qi-guang Lin, A Four-Parameter Model of Glottal Flow, French-Swedish Symposium, Grenoble, Apr. 22–24, 1985, STL-QPSR4/1985, pages 1–13. However, its use is limited because of its computational complexity. This complexity is due to the difference between the specification parameters and the generation parameters of the LF model. Deriving the generation parameters from the specification parameters is computationally complex, because this involves the solving of a nonlinear equation. This is explained hereinafter, together with the LF model.

FIGS. 2*a,* 2*b* show typical examples of g(t) and dg(t)/dt and introduce the specification parameters $t_0$, $t_p$, $t_e$, $t_a$ and $U_o$ or $E_e$ The pitch period has a length $t_0$. Maximum air flow $U_o$ occurs at $t_p$. Maximum excitation with amplitude $E_e$ occurs at the time $t_e$, when the vocal cords collide. The interval with approximate length $t_a=E_e/g(t_e)$, just after the instant of maximum excitation is called the return phase. During this phase the vocal cords reach maximum closure and the air flow reduces to its minimum, which is called leakage. Here we assume zero leakage, therefore $g(0)=g(t_0)=0$. The air flow in the return phase is perceptually important, because it determines the spectral tilt. The parameters $t_0$, $t_p$, $t_e$, $t_a$ are called the T parameters. Instead of the T parameters, sometimes the R parameters are used, that are defined as follows:

$$r_o=t_e/t_0,\ r_a=t_a/t_0,\ rk=(t_e-t_p)/t_0 \quad (1)$$

The parameters $r_o$ and $r_a$ denote the relative duration of the open phase and the return phase, respectively. The parameter rk quantifies the symmetry of the glottal pulse.

Expression (2) is a general description of the glottal air flow derivative g(t), with an exponential decay modelling the return phase. We require $f(0)=0$. Further we have $f(t_e)=0$. Integration leads to an expression for the glottal air flow. Since there is no leakage we require $g(t)\geqq 0$ and $g(0)=g(t_0)=0$, from which the continuity condition (4) is derived, with D given by equation (5). Any parameter of f(t) must be chosen such that condition (4) is satisfied.

In the above definitions for the glottal air flow g(t) and its derivative dg(t)/dt, the parameter $t_a$ is the time constant of the exponential decay in the return phase. This is slightly different from the situation in FIG. 6*a*, where $t_a=E_e/g(t_e)$. For $t_a<<(t_0-t_e)$, which is usually the case, both definitions a simple relation exists between both $t_a$ parameters.

The LF model with the modified definition of $t_a$, follows from (2) and from the choice $$f(t)=B\sin(\pi t/t_p)\exp(\alpha t), \quad (6)$$

wherein B is the amplitude of the glottal-pulse derivative. The generation parameter $\alpha$ can only be solved numerically from the continuity equation (4), which in this case is given by (7): in fact, this equation cannot be made explicitly expressible in $\alpha$. Solving (7) for $\alpha$ is a heavy computational load in a speech synthesizer, where the T parameters may vary typically every 10 ms.

Figure 5A:
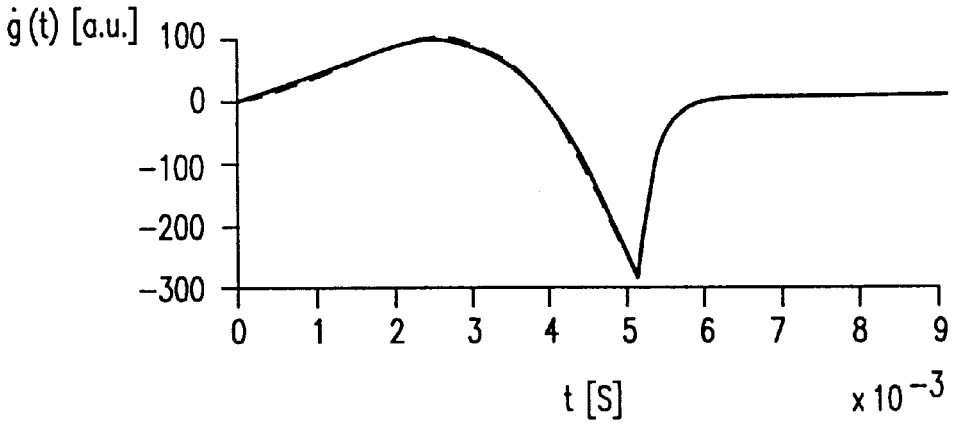
FIG. 5, two comparison diagrams for LF and R++ models.
Figure 5B:
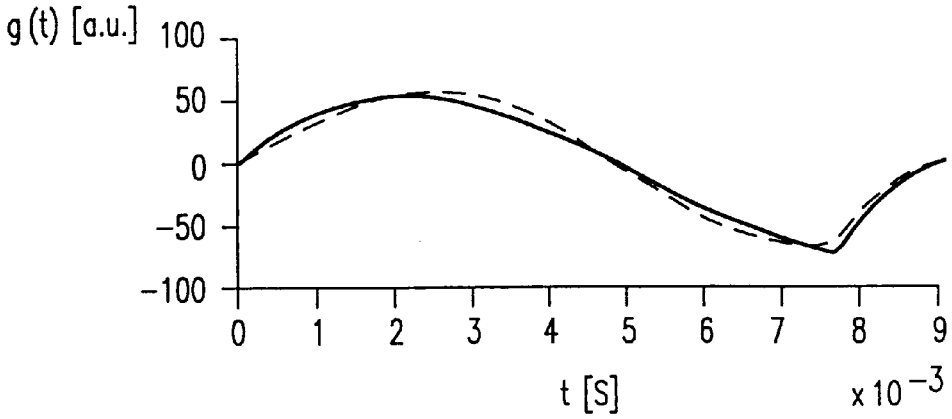

FIG. 5 shows LF (dashed lines) and R++ (solid lines) glottal-pulse derivatives for two sets of R parameters. The top panel shows glottal-pulse derivatives for a modal voice and the bottom panel for an abducted voice source. The R++ waveform closely approximates the LF waveform, provided rk<0.5. For higher values of rk, the approximation is slightly worse. The differences between the results of the two models are small compared with the differences between the LF model and estimated waveforms. This indicates already that both models are equally useful. To further verify applicability in speech synthesizers, perceptual equivalence of the new model with the LF model has been investigated.

This was done by testing whether synthetic vowels generated with the R++ and the LF models at various choices of the R parameters can be perceptually discriminated. The comparing of isolated vowels is psycho-acoustically more critical than the comparing of synthetic speech, in which other synthesis artifacts as well as the context may mask perceptual differences.

In order to choose R parameters corresponding to those of to natural voices, we used the so-called shape parameter $$rd=U_0/E_0*t_0,$$

Simple statistical relations exist between rd and the other R parameters, such that each of the R parameters can be predicted from a measured value of rd. These relations are shown in FIG. 1. We chose the set {0.05, 0.13, 0.21, 0.29, 0.37, 0.45} as the values for rd and used FIG. 1 to determine the R parameters. From recordings of one male and one female voice we derived formant filters and fundamental frequencies for the vowels /a/, /i/ and /u/. Segments of 0.3 s of these vowels were synthesized for the six values of rd with the simplified source filter model of FIG. 1. The glottal pulse derivatives were according to the LF and the R++ models, respectively. The fundamental frequencies and formant filters were kept identical to those obtained from the recordings. Fundamental frequencies of the male and female vowels were approximately 110 Hz and 200 Hz, respectively. The sampling frequency was 8 kHz. This resulted in 36 pairs of stimuli. There was no significant difference between the results of the trials with the LF model and those with the R++ model in the reference trials.

The improved computational efficiency makes it suitable for application in real-time speech synthesizers, such as formant synthesizers. Psychoacoustical comparison of stimuli generated with the R++ and the LF models showed that sometimes discrimination is possible, but that it is unlikely that such will occur in practical cases of speech synthesis.

I claim:

1. A method for coding human speech for subsequent reproduction thereof, said method comprising the steps of:

receiving an amount of human-speech-expressive information;

defining a transfer function of said speech and singling out therefrom all poles that are unrelated to any particular resonance of a human vocal tract model, while maintaining all other poles;

defining a glottal pulse related sequence representing said singled out poles through an explicitation of the derivative of the glottal air flow;

outputting speech represented by filter means based on combining said glottal pulse related sequence and a representation of a formant filter with a complex transfer function as expressing said all other poles, wherein said glottal pulse sequence is modelled through further explicitly expressible generation parameters, said method being characterized by supplementing a non-zero decaying return phase to the glottal-pulse response that is explicitized in all its parameters, whilst amending the overall response in accordance with volumetric continuity.

2. A method as claimed in claim 1, being characterized by in said glottal pulse response introducing a factor that is explicit in the parameter $t_p$, that is the instant of maximum airflow.

3. A method as claimed in claim 2, being characterized by selectively amending one or more of the speech governing parameters $t_p$, $t_e$, that is the instant where the derivative in the glottal pulse is minimum, and $t_a$, that is the first order delay after $t_e$ where the derivative becomes zero.

4. A system arranged for implementing a method as claimed in claim 1.

* * * * *